US009379445B2

(12) United States Patent
Zhu et al.

(10) Patent No.: US 9,379,445 B2
(45) Date of Patent: Jun. 28, 2016

(54) ELECTRONIC DEVICE WITH SATELLITE NAVIGATION SYSTEM SLOT ANTENNAS

(71) Applicant: Apple Inc., Cupertino, CA (US)

(72) Inventors: Jiang Zhu, Sunnyvale, CA (US); Harish Rajagopalan, San Jose, CA (US); Rodney A. Gomez Angulo, Sunnyvale, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 43 days.

(21) Appl. No.: 14/180,866

(22) Filed: Feb. 14, 2014

(65) Prior Publication Data

US 2015/0236426 A1 Aug. 20, 2015

(51) Int. Cl.

| | |
|---|---|
| ***H01Q 1/24*** | (2006.01) |
| ***H01Q 13/10*** | (2006.01) |
| ***H01Q 1/22*** | (2006.01) |

(52) U.S. Cl.

CPC ..... *H01Q 13/10* (2013.01); *H01Q 1/2266* (2013.01); *H01Q 1/243* (2013.01); *H01R 2201/02* (2013.01)

(58) Field of Classification Search

CPC ..... H01Q 1/243; H01Q 13/10; H01R 2201/02
USPC ..... 343/702, 767, 860, 906
See application file for complete search history.

(56) References Cited

U.S. PATENT DOCUMENTS

| | | | |
|---|---|---|---|
| 4,016,490 | A | 4/1977 | Weckenmann et al. |
| 4,614,937 | A | 9/1986 | Poujois |
| 5,337,353 | A | 8/1994 | Boie |
| 5,410,497 | A | 4/1995 | Viletto |
| 5,463,406 | A | 10/1995 | Vannatta et al. |
| 5,650,597 | A | 7/1997 | Redmayne |
| 5,826,458 | A | 10/1998 | Little |
| 5,854,972 | A | 12/1998 | Pennock et al. |

(Continued)

FOREIGN PATENT DOCUMENTS

| | | |
|---|---|---|
| CN | 1343380 | 4/2002 |
| CN | 1543010 | 11/2004 |

(Continued)

OTHER PUBLICATIONS

Liu et al., MEMS-Switched, Frequency-Tunable Hybrid Slot/PIFA Antenna; IEEE Antennas and Wireless Propagation Letters, vol. 8, 2009: p. 311-314.

(Continued)

*Primary Examiner* — Joseph Lauture

(74) *Attorney, Agent, or Firm* — Treyz Law Group, P.C.; G. Victor Treyz; Michael H. Lyons

(57) ABSTRACT

An electronic device may be provided with a satellite positioning system slot antenna. The slot antenna may include a slot in a metal housing. The slot may be directly fed or indirectly fed. In indirectly fed configurations, the antenna may include a near-field-coupled antenna feed structure that is near-field coupled to the slot. The near-field-coupled antenna feed structure may be formed from a planar metal structure. The planar metal structure may be a metal patch that overlaps the slot and that has a leg that protrudes towards the metal housing. A positive antenna feed terminal may be coupled to the leg and a ground antenna feed terminal may be coupled to the metal housing.

16 Claims, 16 Drawing Sheets

(56) References Cited

U.S. PATENT DOCUMENTS 5,864,316 A 1/1999 Bradley et al.
5,905,467 A 5/1999 Narayanaswamy et al.
5,956,626 A 9/1999 Kashke et al.
6,181,281 B1 1/2001 Desclos
6,301,489 B1 10/2001 Winstead et al.
6,329,958 B1 12/2001 McLean et al.
6,380,899 B1 4/2002 Madsen et al.
6,408,193 B1 6/2002 Katagishi et al.
6,456,856 B1 9/2002 Werling et al.
6,480,162 B2 11/2002 Sabet et al.
6,529,088 B2 3/2003 Lafleur et al.
6,590,539 B2 7/2003 Shinichi
6,611,227 B1 8/2003 Nebiyeloul-Kifle et al.
6,657,595 B1 12/2003 Phillips et al.
6,678,532 B1 1/2004 Mizoguchi
6,741,214 B1 5/2004 Kadambi et al.
6,788,266 B2 9/2004 St. Hillaire
6,879,293 B2 4/2005 Sato
6,975,276 B2 12/2005 Brown
6,978,121 B1 12/2005 Lane et al.
6,985,108 B2 1/2006 Mikkola
6,985,113 B2 1/2006 Nishimura et al.
7,016,686 B2 3/2006 Spaling
7,039,435 B2 5/2006 McDowell et al.
7,050,010 B2 5/2006 Wang et al.
7,109,945 B2 9/2006 Mori
7,113,087 B1 9/2006 Casebolt
7,146,139 B2 12/2006 Nevermann
7,221,092 B2 5/2007 Anzai et al.
7,356,361 B1 4/2008 Hawkins et al.
7,388,550 B2 6/2008 McLean
7,499,722 B2 3/2009 McDowell et al.
7,502,221 B2 3/2009 Fuller et al.
7,522,846 B1 4/2009 Lewis et al.
7,538,760 B2 5/2009 Hotelling et al.
7,551,142 B1 6/2009 Zhang et al.
7,557,760 B2 7/2009 Chang et al.
7,595,788 B2 9/2009 Son
7,633,076 B2 12/2009 Huppi et al.
7,663,612 B2 2/2010 Bladt
7,705,787 B2 4/2010 Ponce De Leon
7,826,875 B2 11/2010 Karaoguz et al.
7,834,813 B2 11/2010 Caimi et al.
7,864,123 B2 1/2011 Hill et al.
7,876,274 B2 1/2011 Hobson et al.
7,999,748 B2 8/2011 Ligtenberg et al.
8,059,039 B2 11/2011 Ayala Vazquez et al.
8,059,040 B2 11/2011 Ayala Vazquez et al.
8,115,753 B2 2/2012 Newton
8,159,399 B2 4/2012 Dorsey et al.
8,228,198 B2 7/2012 McAllister
8,238,971 B2 8/2012 Terlizzi
8,255,009 B2 8/2012 Sorenson et al.
8,270,914 B2 9/2012 Pascolini et al.
8,319,692 B2 11/2012 Chiang et al.
8,325,094 B2 12/2012 Ayala Vazquez et al.
8,326,221 B2 12/2012 Dorsey et al.
8,347,014 B2 1/2013 Schubert et al.
8,368,602 B2 2/2013 Hill
8,417,296 B2 4/2013 Caballero et al.
8,432,322 B2 4/2013 Amm
8,436,816 B2 5/2013 Leung et al.
8,466,839 B2 6/2013 Schlub et al.
8,497,806 B2 7/2013 Lai
8,517,383 B2 8/2013 Wallace et al.
8,525,734 B2 9/2013 Krogerus
8,531,337 B2 9/2013 Soler Castany et al.
8,577,289 B2 11/2013 Schlub et al.
8,610,629 B2 12/2013 Pascolini et al.
8,638,266 B2 1/2014 Liu et al.
8,638,549 B2 1/2014 Garelli et al.
8,648,752 B2 2/2014 Ramachandran et al.
8,749,523 B2 6/2014 Pance et al.
8,781,420 B2 7/2014 Schlub et al.
8,798,554 B2 8/2014 Darnell et al.
8,836,587 B2 9/2014 Darnell et al.
8,872,706 B2 10/2014 Caballero et al.
8,896,488 B2 11/2014 Ayala Vazquez et al.
8,947,302 B2 2/2015 Caballero et al.
8,947,305 B2 2/2015 Amm et al.
8,952,860 B2 2/2015 Li et al.
8,963,782 B2 2/2015 Ayala Vazquez et al.
8,963,784 B2 2/2015 Zhu et al.
9,024,823 B2 5/2015 Bevelacqua
9,093,752 B2 7/2015 Yarga et al.
9,153,874 B2 10/2015 Ouyang et al.
2002/0015024 A1 2/2002 Westerman et al.
2002/0027474 A1 3/2002 Bonds
2002/0060645 A1 5/2002 Shinichi
2002/0094789 A1 7/2002 Harano
2002/0123309 A1 9/2002 Collier et al.
2003/0062907 A1 4/2003 Nevermann
2003/0186728 A1 10/2003 Manjo
2003/0193438 A1 10/2003 Yoon
2003/0197597 A1 10/2003 Bahl et al.
2003/0210203 A1 11/2003 Phillips et al.
2003/0218993 A1 11/2003 Moon et al.
2004/0051670 A1 3/2004 Sato
2004/0080457 A1 4/2004 Guo
2004/0104853 A1 6/2004 Chen
2004/0176083 A1 9/2004 Shiao et al.
2004/0189542 A1 9/2004 Mori
2004/0222926 A1 11/2004 Kontogeorgakis et al.
2004/0239575 A1 12/2004 Shoji
2005/0146475 A1 7/2005 Bettner
2005/0168384 A1 8/2005 Wang et al.
2005/0245204 A1 11/2005 Vance
2005/0264466 A1 12/2005 Hibino et al.
2006/0001576 A1 1/2006 Contopanagos
2006/0152497 A1 7/2006 Rekimoto
2006/0161871 A1 7/2006 Hotelling et al.
2006/0232468 A1 10/2006 Parker et al.
2006/0244663 A1 11/2006 Fleck et al.
2006/0248363 A1 11/2006 Chen et al.
2006/0274493 A1 12/2006 Richardson et al.
2006/0278444 A1 12/2006 Binstead
2007/0120740 A1 5/2007 Iellici
2007/0126711 A1 6/2007 Oshita
2007/0188375 A1 8/2007 Richards et al.
2007/0239921 A1 10/2007 Toorians et al.
2008/0165063 A1 7/2008 Schlub et al.
2008/0246735 A1 10/2008 Reynolds et al.
2008/0248837 A1 10/2008 Kunkel
2008/0297487 A1 12/2008 Hotelling et al.
2008/0309836 A1 12/2008 Sakama et al.
2008/0316120 A1 12/2008 Hirota et al.
2009/0000023 A1 1/2009 Wegelin et al.
2009/0096683 A1 4/2009 Rosenblatt et al.
2009/0128435 A1 5/2009 Jeng
2009/0153407 A1 6/2009 Zhang et al.
2009/0153410 A1 6/2009 Chiang
2009/0174611 A1 7/2009 Schlub et al.
2009/0256757 A1* 10/2009 Chiang ..... H01Q 13/10 343/702
2009/0256758 A1 10/2009 Schlub et al.
2009/0295648 A1 12/2009 Dorsey et al.
2010/0062728 A1 3/2010 Black et al.
2010/0079351 A1 4/2010 Huang
2010/0081374 A1 4/2010 Moosavi
2010/0109971 A2 5/2010 Gummalla et al.
2010/0167672 A1 7/2010 Ahn et al.
2010/0182203 A1 7/2010 See
2010/0238072 A1 9/2010 Ayatollahi et al.
2010/0253651 A1 10/2010 Day
2011/0012793 A1 1/2011 Amm et al.
2011/0012794 A1 1/2011 Schlub et al.
2011/0045789 A1 2/2011 Sinton et al.
2011/0050509 A1 3/2011 Ayala Vazquez et al.
2011/0212746 A1 9/2011 Sarkar et al.
2011/0241949 A1 10/2011 Nickel et al.
2011/0260924 A1 10/2011 Roy
2011/0260939 A1 10/2011 Korva et al.
2011/0300907 A1 12/2011 Hill et al.
2012/0009983 A1 1/2012 Mow et al.

(56) References Cited

U.S. PATENT DOCUMENTS

| | | | | |
|---|---|---|---|---|
| 2012/0068893 | A1 | 3/2012 | Guterman et al. | |
| 2012/0092298 | A1 | 4/2012 | Koottungal | |
| 2012/0112970 | A1 | 5/2012 | Caballero et al. | |
| 2012/0176279 | A1 | 7/2012 | Merz et al. | |
| 2012/0214412 | A1 | 8/2012 | Schlub et al. | |
| 2012/0223865 | A1 | 9/2012 | Li et al. | |
| 2012/0223866 | A1 | 9/2012 | Ayala Vazquez et al. | |
| 2012/0229360 | A1* | 9/2012 | Jagielski | H01Q 9/30 343/860 |
| 2012/0299785 | A1 | 11/2012 | Bevelacqua | |
| 2013/0050038 | A1 | 2/2013 | Eom et al. | |
| 2013/0106660 | A1 | 5/2013 | Kang | |
| 2013/0115884 | A1 | 5/2013 | Zhang | |
| 2013/0154900 | A1* | 6/2013 | Tsai | H01Q 1/243 343/906 |
| 2013/0169490 | A1 | 7/2013 | Pascolini et al. | |
| 2013/0201067 | A1 | 8/2013 | Hu et al. | |
| 2013/0203364 | A1 | 8/2013 | Darnell et al. | |
| 2013/0234910 | A1 | 9/2013 | Oh et al. | |
| 2013/0241800 | A1 | 9/2013 | Schlub et al. | |
| 2013/0257659 | A1 | 10/2013 | Darnell et al. | |
| 2013/0285857 | A1 | 10/2013 | Schultz | |
| 2013/0293425 | A1 | 11/2013 | Zhu et al. | |
| 2013/0321216 | A1 | 12/2013 | Jervis et al. | |
| 2013/0328730 | A1 | 12/2013 | Guterman et al. | |
| 2013/0342411 | A1 | 12/2013 | Jung | |
| 2014/0009352 | A1 | 1/2014 | Sung | |
| 2014/0086441 | A1 | 3/2014 | Zhu | |
| 2014/0184450 | A1 | 7/2014 | Koo | |
| 2014/0253392 | A1 | 9/2014 | Yarga et al. | |
| 2014/0266922 | A1 | 9/2014 | Jin et al. | |
| 2014/0266923 | A1 | 9/2014 | Zhou et al. | |
| 2014/0266938 | A1 | 9/2014 | Ouyang et al. | |
| 2014/0266941 | A1 | 9/2014 | Vazquez | |
| 2014/0292587 | A1 | 10/2014 | Yarga et al. | |
| 2014/0292598 | A1 | 10/2014 | Bevelacqua et al. | |
| 2014/0306857 | A1 | 10/2014 | Bevelacqua et al. | |
| 2014/0313087 | A1 | 10/2014 | Jiang et al. | |
| 2014/0315592 | A1 | 10/2014 | Schlub et al. | |
| 2014/0328488 | A1 | 11/2014 | Caballero et al. | |
| 2014/0333495 | A1 | 11/2014 | Vazquez et al. | |
| 2014/0333496 | A1 | 11/2014 | Hu et al. | |
| 2014/0340265 | A1 | 11/2014 | Ayala Vazquez et al. | |
| 2014/0375509 | A1 | 12/2014 | Vance et al. | |
| 2015/0180123 | A1 | 6/2015 | Tatomirescu | |
| 2015/0236426 | A1 | 8/2015 | Zhu et al. | |
| 2015/0270618 | A1 | 9/2015 | Zhu et al. | |
| 2015/0270619 | A1 | 9/2015 | Zhu et al. | |
| 2015/0311594 | A1 | 10/2015 | Zhu et al. | |

FOREIGN PATENT DOCUMENTS

| | | | |
|---|---|---|---|
| CN | 101330162 | | 12/2008 |
| DE | 102005035935 | | 2/2007 |
| EP | 0086135 | | 8/1983 |
| EP | 0 564 164 | | 10/1993 |
| EP | 1296809 | | 4/2003 |
| EP | 1324425 | | 7/2003 |
| EP | 1361623 | | 11/2003 |
| EP | 1 469 550 | | 10/2004 |
| EP | 1 524 774 | | 4/2005 |
| EP | 1564896 | | 8/2005 |
| EP | 1593988 | | 11/2005 |
| GB | 2 380 359 | | 4/2003 |
| JP | 05/128828 | | 5/1993 |
| JP | 2003179670 | | 6/2003 |
| JP | 2003209483 | | 7/2003 |
| JP | 2003330618 | | 11/2003 |
| JP | 2004005516 | | 1/2004 |
| JP | 200667061 | | 3/2006 |
| JP | 2007-170995 | | 7/2007 |
| JP | 2008046070 | | 2/2008 |
| JP | 2009032570 | | 2/2009 |
| WO | 0131733 | | 5/2001 |
| WO | 02/05443 | | 1/2002 |
| WO | 2004010528 | | 1/2004 |
| WO | 2004112187 | | 12/2004 |
| WO | 2005112280 | | 11/2005 |
| WO | 2007116790 | | 4/2006 |
| WO | 2006060232 | | 6/2006 |
| WO | 2007124333 | | 1/2007 |
| WO | 2008/078142 | | 7/2008 |
| WO | 2009022387 | | 2/2009 |
| WO | 2009149023 | | 12/2009 |
| WO | 2011022067 | | 2/2011 |
| WO | 2013123109 | A1 | 8/2013 |
| WO | 2013165419 | | 11/2013 |

OTHER PUBLICATIONS

Myllmaki et al., "Capacitive recognition of the user's hand grip position in mobile handsets", Progress in Electromagnetics Research B, vol. 22, 2010, pp. 203-220.

"CapTouch Programmable Controller for Single-Electrode Capacitance Sensors", AD7147 Data Sheet Rev. B, [online], Analog Devices, Inc., [retrieved on Dec. 7, 2009], <URL: http://www.analog.com/static/imported-files/data_sheets/AD7147.pdf>.

Pance et al., U.S. Appl. No. 61/235,905, filed Aug. 21, 2009.

Yarga et al., U.S. Appl. No. 13/790,549, filed Mar. 8, 2013.

Jiang et al., U.S. Appl. No. 13/864,968, filed Apr. 17, 2013.

Schlub et al., U.S. Appl. No. 13/420,278, filed Mar. 14, 2012.

Zhu et al., U.S. Appl. No. 13/402,831, filed Feb. 22, 2012.

Ayala Vazquez et al., U.S. Appl. No. 13/895,194, filed May 15, 2013.

Bevelacqua et al., U.S. Appl. No. 13/860,396, filed Apr. 10, 2013.

Vazquez et al., U.S. Appl. No. 13/889,987, filed May 8, 2013.

Hu et al., U.S. Appl. No. 13/890,013, filed May 8, 2013.

Bevelacqua et al., U.S. Appl. No. 13/851,471, filed Mar. 27, 2013.

Jin et al., U.S. Appl. No. 13/846,471, filed Mar. 18, 2013.

Ouyang et al., U.S. Appl. No. 13/846,459, filed Mar. 18, 2013.

Zhou et al., U.S. Appl. No. 13/846,481, filed Mar. 18, 2013.

Schlub et al., U.S. Appl. No. 13/865,578, filed Apr. 18, 2013.

Caballero et al., U.S. Appl. No. 13/886,157, filed May 2, 2013.

Yarga et al., U.S. Appl. No. 13/855,568, filed Apr. 2, 2013.

Guterman et al., U.S. Appl. No. 14/202,860, filed Mar. 10, 2014.

The ARRL Antenna Book, Published by the American Radio Relay League, 1988.

Pascolini et al., U.S. Appl. No. 14/710,377, filed May 12, 2015.

Jadhav et al., U.S. Appl. No. 14/201,620, filed Mar. 7, 2014.

Azad et al., U.S. Appl. No. 15/066,419, filed Mar. 10, 2016.

* cited by examiner

ELECTRONIC DEVICE WITH SATELLITE NAVIGATION SYSTEM SLOT ANTENNAS

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided with antennas. The antennas may include a satellite navigation system antenna that provides satellite navigation system signals to a satellite navigation system receiver.

The satellite navigation system antenna may be a slot antenna. The electronic device may have a housing such as a metal housing. The slot antenna may include a slot antenna resonating element formed from a slot in the metal housing. The slot in the metal housing may be filled with a dielectric such as plastic.

The slot may extend across a planar rear housing wall and may extend up a sidewall of the housing. The slot may have no bends or may have one or more bends. The slot may be an open slot having an open end or may be a closed slot that is enclosed and surrounded by portions of the metal housing.

The slot may be directly fed or indirectly fed. In directly fed configurations, a positive antenna feed may be coupled to the metal housing on one side of the slot and a ground antenna feed may be coupled to the metal housing on another side of the slot.

In indirectly fed configurations, the antenna may include a near-field-coupled antenna feed structure that is near-field coupled to the slot. The near-field-coupled antenna feed structure may be formed from a planar metal structure. The planar metal structure may be a metal patch that overlaps the slot and that has a leg that protrudes towards the metal housing. A positive antenna feed terminal may be coupled to the leg and a ground antenna feed terminal may be coupled to the metal housing.

A satellite navigation system slot antenna may be coupled to a satellite navigation system receiver using a transmission line coupled between the antenna feed terminals and the satellite navigation system receiver.

DETAILED DESCRIPTION

Electronic devices may be provided with antennas. The antennas may include slot antennas formed in device structures such as electronic device housing structures. Illustrative electronic devices that have housings that accommodate slot antennas are shown in FIGS. 1, 2, 3, and 4.

Figure 1:
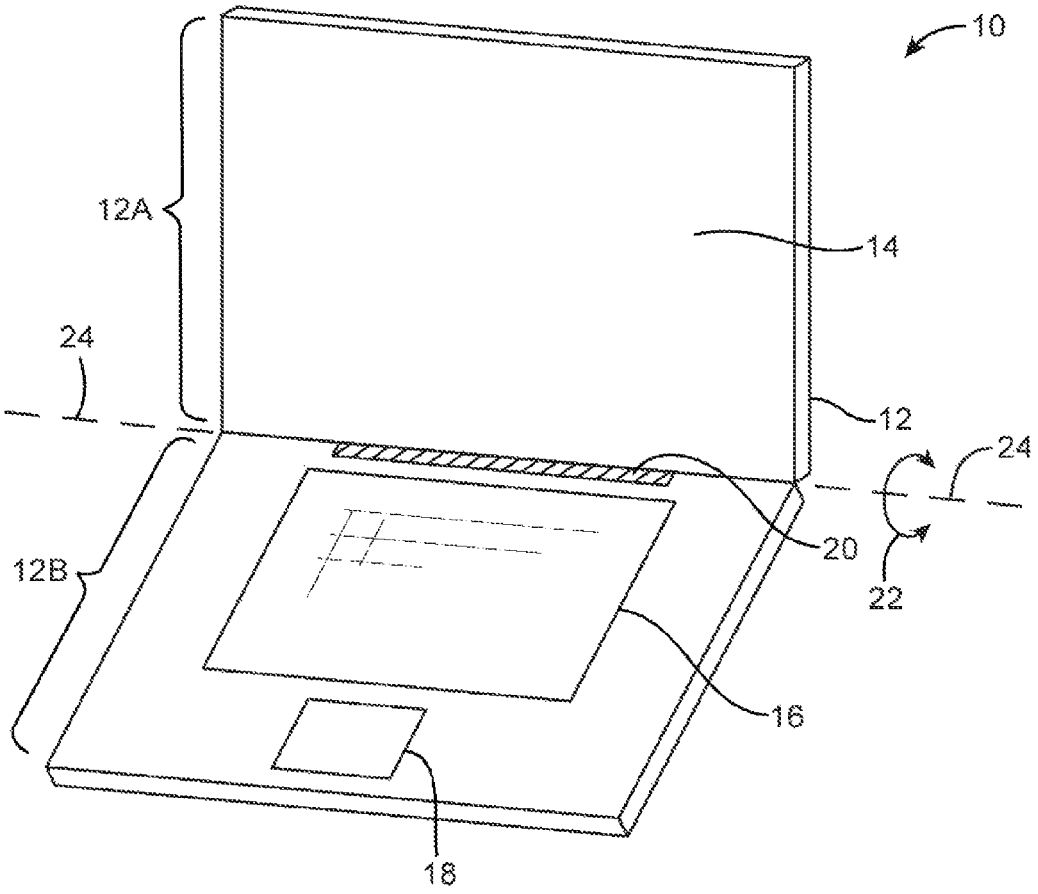
FIG. 1 is a perspective view of an illustrative electronic device such as a laptop computer in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in housing 12A. Upper housing 12A, which may sometimes referred to as a display housing or lid, is placed in a closed position by rotating upper housing 12A towards lower housing 12B about rotational axis 24.

Figure 2:
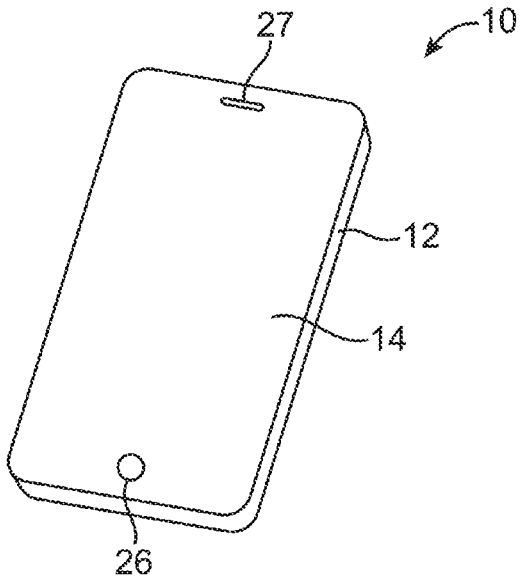
FIG. 2 is a perspective view of an illustrative electronic device such as a handheld electronic device in accordance with an embodiment.

FIG. 2 shows an illustrative configuration for electronic device 10 based on a handheld device such as a cellular telephone, music player, gaming device, navigation unit, or other compact device. In this type of configuration for device 10, device 10 has opposing front and rear surfaces. The rear surface of device 10 may be formed from a planar portion of housing 12. Display 14 forms the front surface of device 10. Display 14 may have an outermost layer that includes openings for components such as button 26 and speaker port 27.

Figure 3:
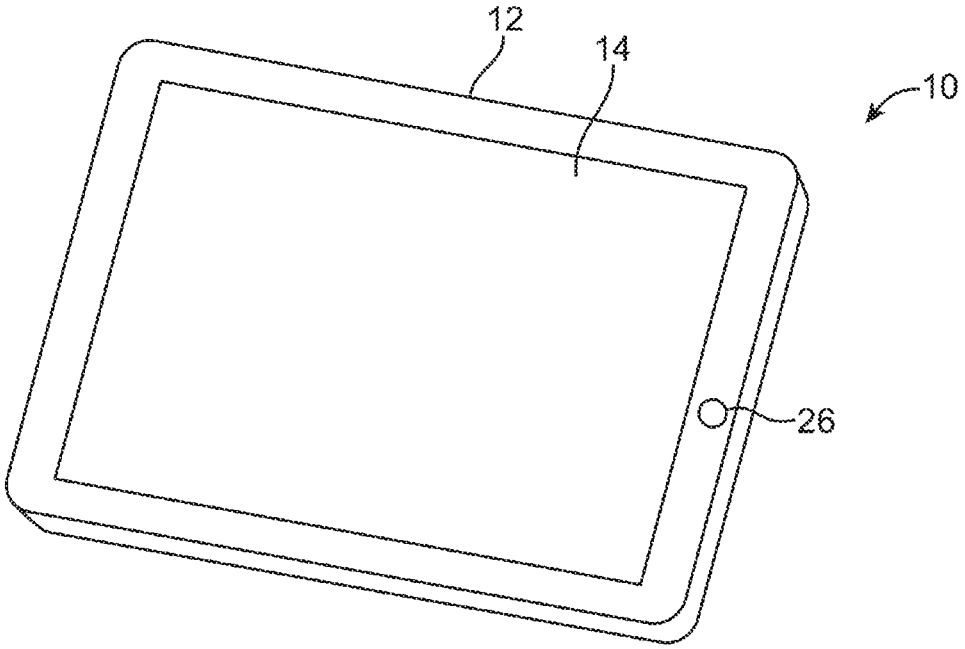
FIG. 3 is a perspective view of an illustrative electronic device such as a tablet computer in accordance with an embodiment.

In the example of FIG. 3, electronic device 10 is a tablet computer. In electronic device 10 of FIG. 3, device 10 has opposing planar front and rear surfaces. The rear surface of device 10 is formed from a planar rear wall portion of housing 12. Curved or planar sidewalls may run around the periphery of the planar rear wall and may extend vertically upwards. Display 14 is mounted on the front surface of device 10 in housing 12. As shown in FIG. 3, display 14 has an outermost layer with an opening to accommodate button 26.

Figure 4:
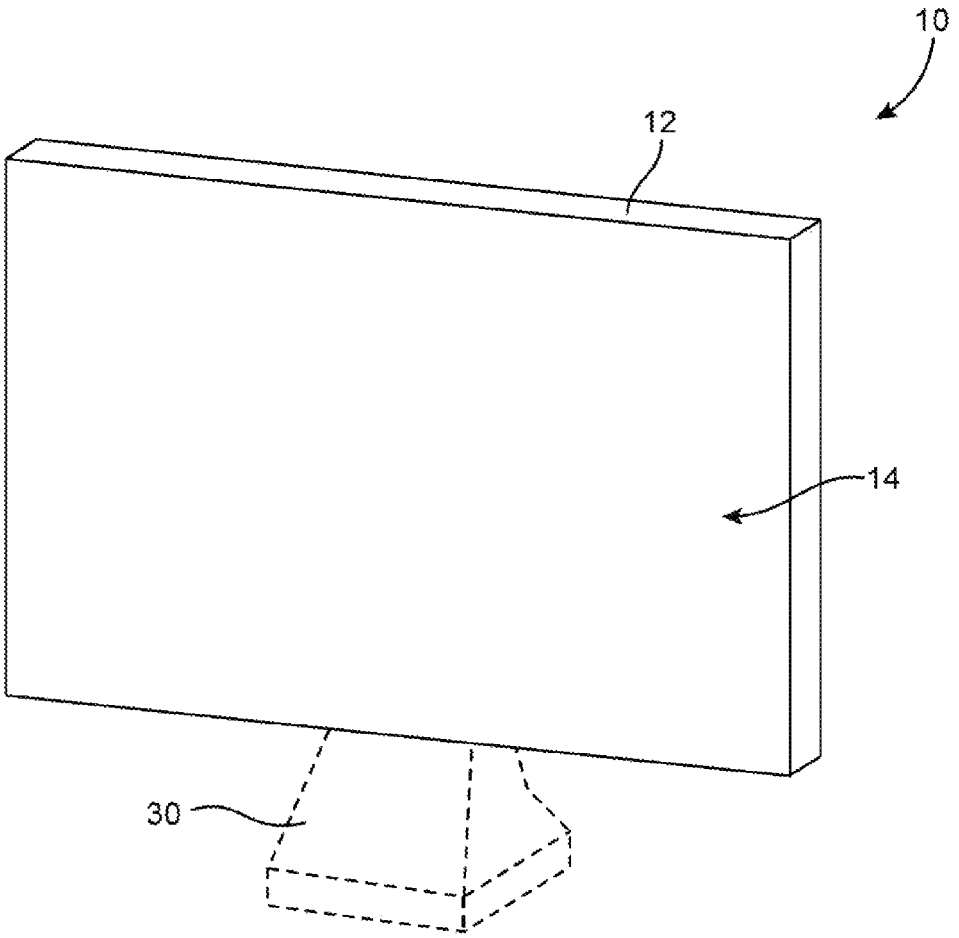
FIG. 4 is a perspective view of an illustrative electronic device such as a display for a computer or television in accordance with an embodiment.

FIG. 4 shows an illustrative configuration for electronic device 10 in which device 10 is a computer display, a computer that has an integrated computer display, or a television. Display 14 is mounted on a front face of device 10 in housing 12. With this type of arrangement, housing 12 for device 10 may be mounted on a wall or may have an optional structure such as support stand 30 to support device 10 on a flat surface such as a table top or desk.

An electronic device such as electronic device 10 of FIGS. 1, 2, 3, and 4, may, in general, be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The examples of FIGS. 1, 2, 3, and 4 are merely illustrative.

Device 10 may include a display such as display 14. Display 14 may be mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button, an opening may be formed in the display cover layer to accommodate a speaker port, etc.

Housing 12 may be formed from conductive materials and/or insulating materials. In configurations in which housing 12 is formed from plastic or other dielectric materials, antenna signals can pass through housing 12. Antennas in this type of configuration can be mounted behind a portion of housing 12. In configurations in which housing 12 is formed from a conductive material (e.g., metal), it may be desirable to provide one or more radio-transparent antenna windows in openings in the housing. As an example, a metal housing may have openings that are filled with plastic antenna windows. Antennas may be mounted behind the antenna windows and may transmit and/or receive antenna signals through the antenna windows.

Figure 5:
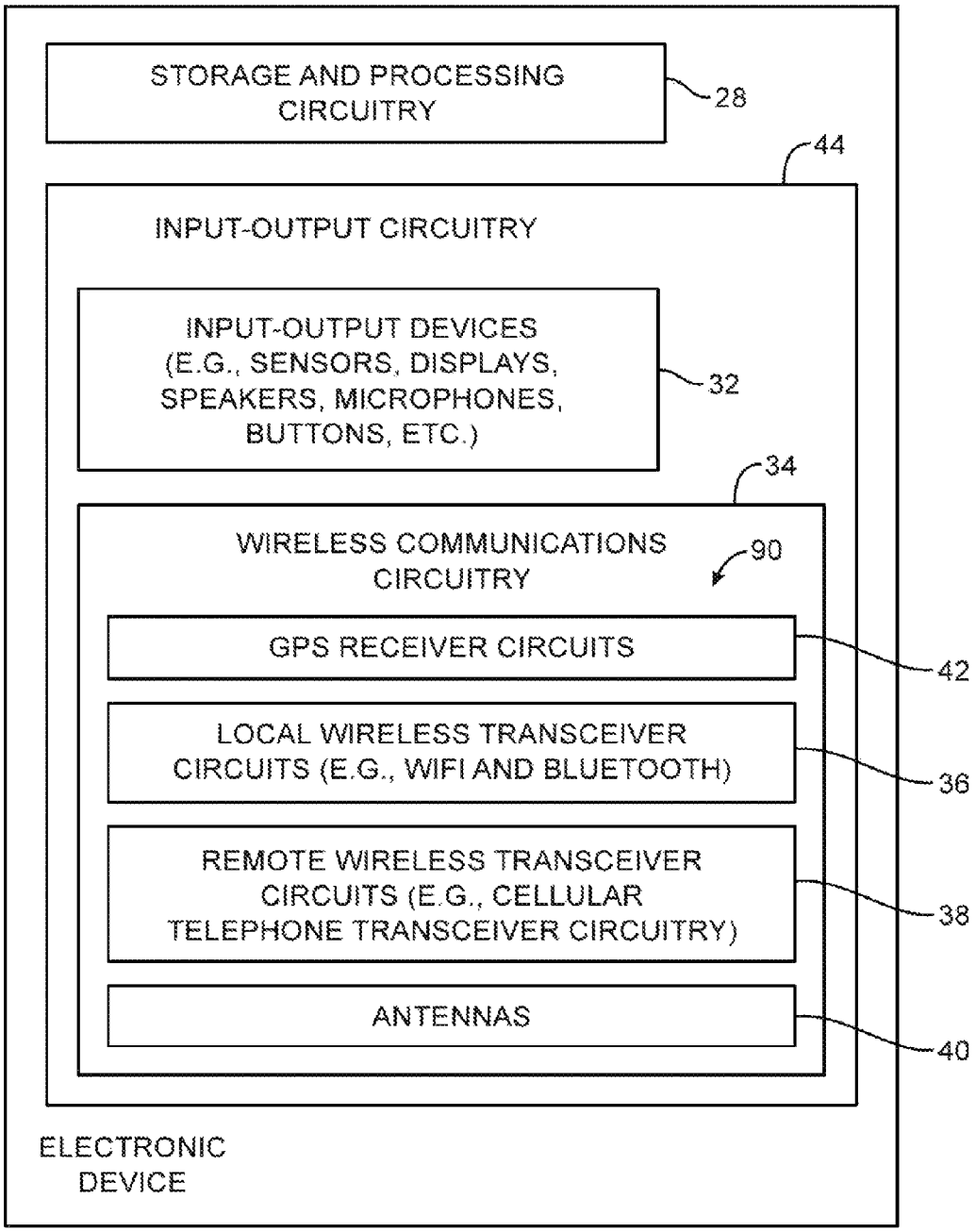
FIG. 5 is a schematic diagram of illustrative circuitry in an electronic device in accordance with an embodiment.

FIG. 5 is a schematic diagram showing illustrative components that may be used in device 10. As shown in FIG. 5, device 10 may include control circuitry such as storage and processing circuitry 28 and input-output circuitry 44. Storage and processing circuitry 28, which may sometimes be referred to as control circuitry, and input-output circuitry 44 may be housed within housing 12.

Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 6:
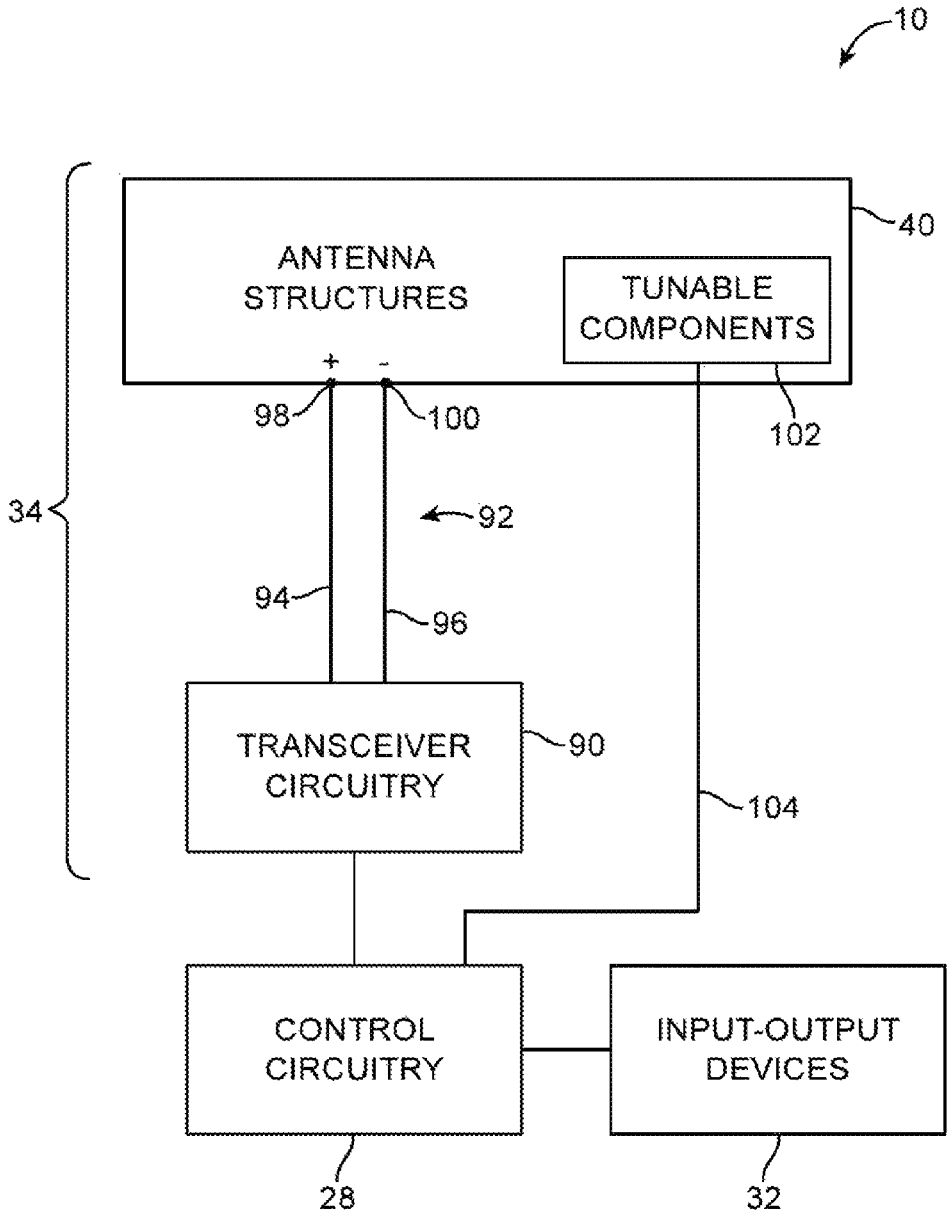
FIG. 6 is a schematic diagram of illustrative wireless circuitry in accordance with an embodiment.

As shown in FIG. 6, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 28 may issue control signals on one or more paths such as path 104 that adjust inductance values, capacitance values, or other parameters associated with tunable components 102, thereby tuning antenna structures 40 to cover desired communications bands.

Path 92 may include one or more transmission lines. As an example, signal path 92 of FIG. 6 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission lines such as transmission line 92 may be directly coupled to an antenna resonating element and ground for an antenna or may be coupled to near-field-coupled antenna feed structures that are used in indirectly feeding a resonating element for an antenna. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. As another example, antenna structures 40 may include an antenna resonating element such as a slot antenna resonating element or other element that is indirectly fed using near-field coupling. In a near-field coupling arrangement, transmission line 92 is coupled to a near-field-coupled antenna feed structure that is used to indirectly feed antenna structures such as an antenna slot or other antenna resonating element through near-field electromagnetic coupling.

Figure 9:
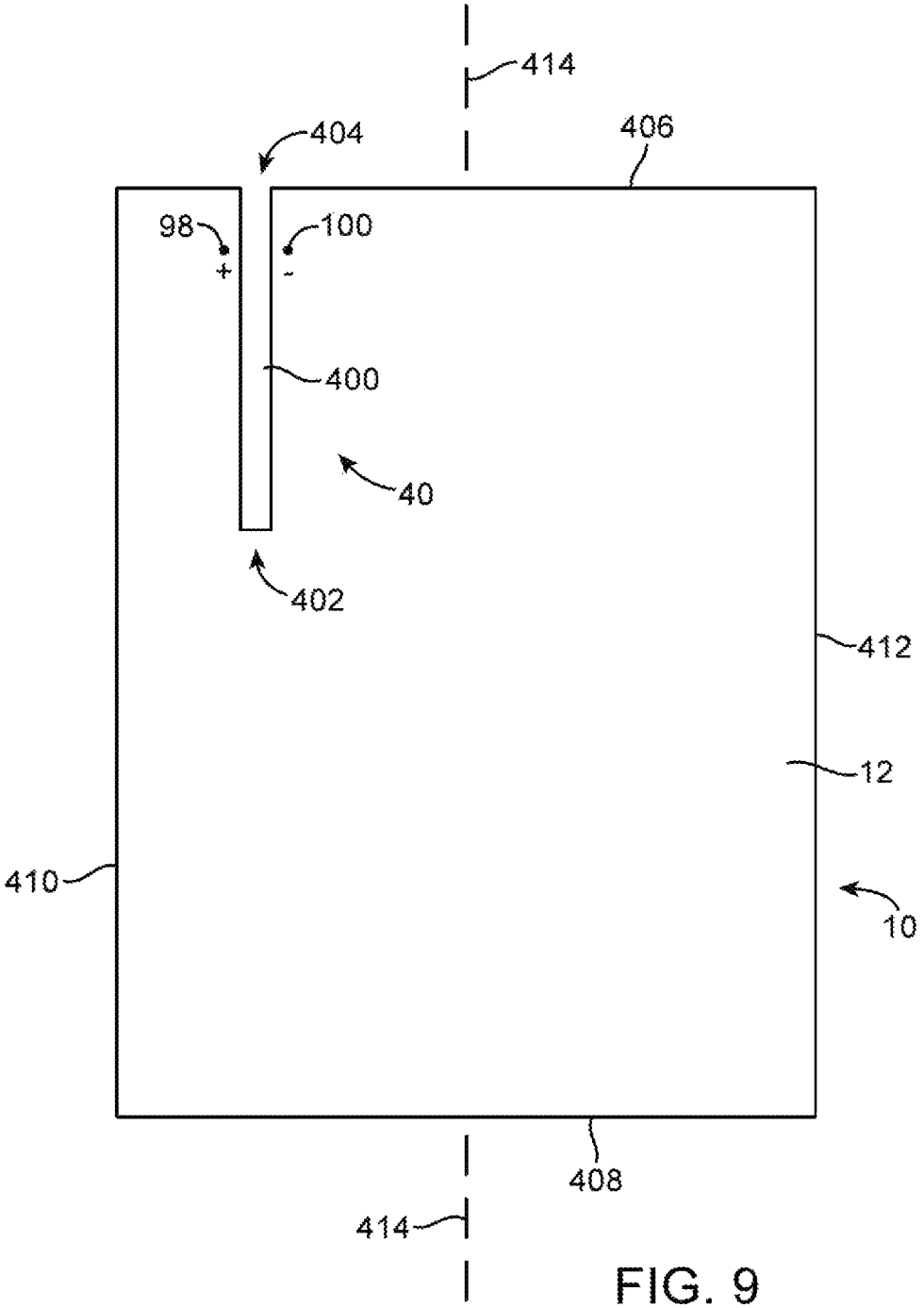
FIG. 9 is a top view of an illustrative ground plane in an electronic device that has been provided with an antenna based on an open-ended slot running parallel to the longer of two lateral dimensions associated with the ground plane in accordance with an embodiment.

FIG. 9 shows how antenna 40 may be indirectly fed using a near-field coupling arrangement. With this type of arrangement, transceiver 90 is connected to near-field-coupled antenna feed structure 202 by transmission line 92. Antenna 40 may include a resonating element such as a slot or other antenna resonating element structure (antenna element 400). Structure 202 may include a strip of metal, a patch of metal, planar metal members with other shapes, a loop of metal, or other structure that is near-field coupled to antenna resonating element 400 by near-field coupled electromagnetic signals 204. Structure 202 does not produce significant far-field radiation during operation (i.e., structure 202 does not itself form a far-field antenna but rather serves as a coupled feed for a slot antenna structure or other antenna resonating element structure for antenna 40). During operation, the indirect feeding of element 400 by structure 202 allows antenna element 400 and therefore antenna 40 to receive and/or transmit far-field wireless signals 205 (i.e., radio-frequency antenna signals for antenna 40).

Figure 8:
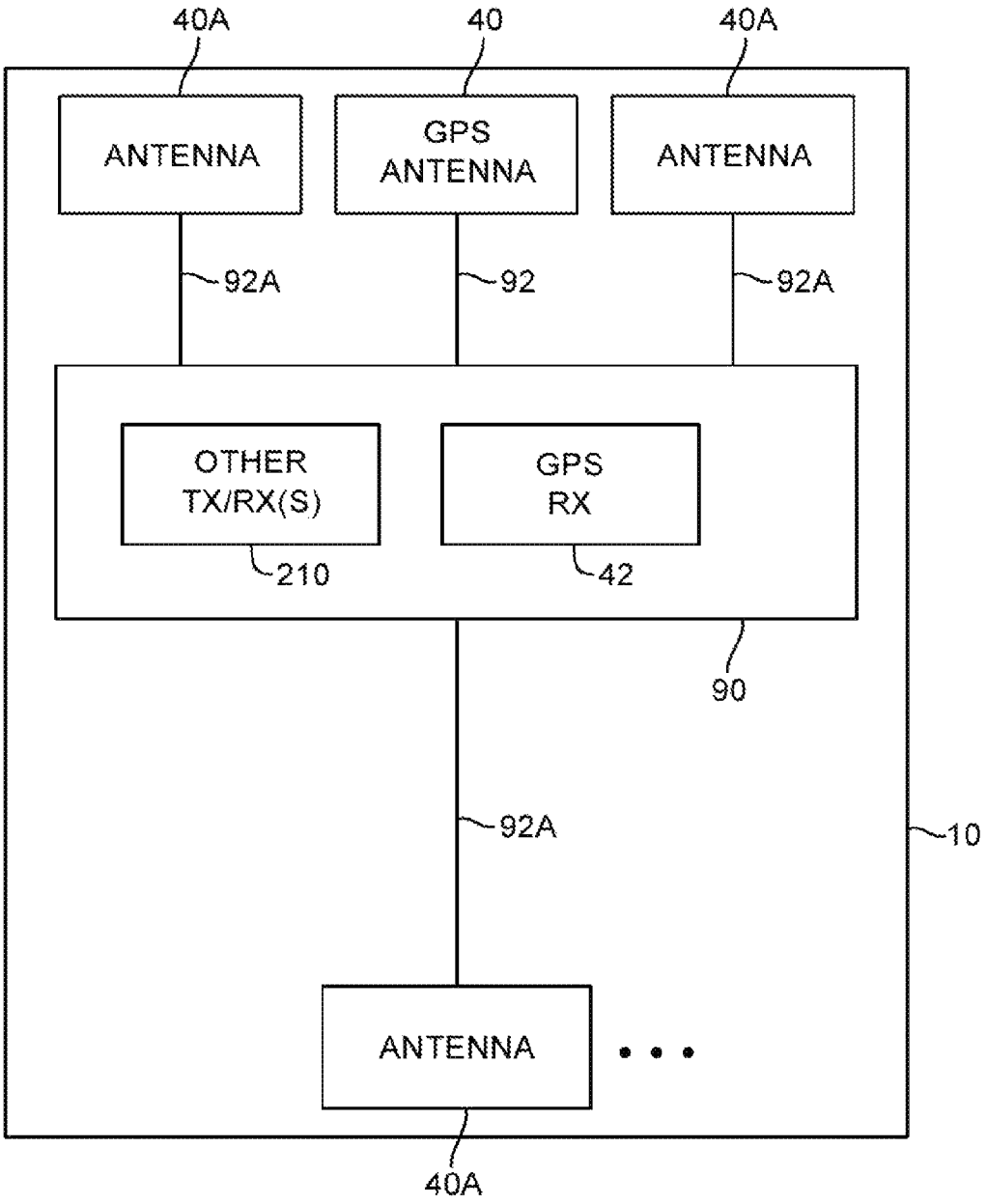
FIG. 8 is a schematic diagram of an illustrative electronic device that includes a satellite navigation system antenna such as a Global Positioning System antenna and that includes additional antennas in accordance with an embodiment.

As shown in FIG. 8, device 10 may have multiple antennas such as satellite navigation system antenna 40 (e.g., a Global Positioning System antenna) and additional antennas 40A. Satellite navigation system antenna 40 may be coupled to satellite navigation system receiver 42 in transceiver circuitry 90 using a signal path such as transmission line 92. Antenna 40 may be used to receive satellite navigation system signals for receiver 42 that are provided to receiver 42 by transmission line 92. Antenna 40 may, if desired, handle additional wireless traffic such as cellular telephone system signals, wireless local area network signals, and other wireless signals using other transceivers 210 (e.g., cellular telephone transceivers, etc.). Additional antennas 40A may be coupled to transceiver circuitry 90 by signal paths such as transmission line paths 92A. There may be no additional antennas 40A in device 10 (i.e., device 10 may contain only antenna 40), there may be one additional antenna 40A, there may be more than one additional antenna 40A, there may be two or more additional antennas 40A, or there may be any other suitable number of antennas 40A in device 10.

Antennas in device 10 such as antenna 40 and additional antenna(s) 40A may be based on antenna resonating elements that are formed from loop antenna structures, patch antenna structures, inverted-F antenna structures, slot antenna structures, planar inverted-F antenna structures, helical antenna structures, hybrids of these designs, or other suitable antenna designs. With one suitable arrangement, antenna 40 (and, if desired, one or more of antennas 40A) may be slot antennas.

An illustrative slot antenna is shown in FIG. 9. As shown in FIG. 9, device 10 may have a ground plane formed from housing 12 (e.g., a metal housing). Antenna 40 may be formed from a slot in the ground plane such as slot 400. Slot 400 may have opposing ends such as ends 402 and 404. End 402 may be surrounded by portions of housing (ground plane) 12 and may therefore be referred to as the closed end of slot 400. End 404 may be exposed to the environment (air) surrounding device 10 and may therefore be referred to as the open end of slot 400. Slots such as slot 400 that have an open end are sometimes referred to as open slots (i.e., antenna 40 of FIG. 9 is an open slot antenna). Opening 404 may be formed in a sidewall of housing 12 or other portion of housing 12 (e.g., along one of the peripheral edges of housing 12 such as edge 406). Antenna 40 may be fed using an indirect feeding arrangement or may be directly fed using an antenna feed formed from feed terminals coupled to housing 12 on opposing sides of slot 400 such as positive antenna feed terminal 98 and ground antenna feed terminal 100. Slot 400 may be filled with air, plastic, or other dielectric material and may therefore sometimes be referred to as a dielectric-filled slot.

In the illustrative configuration of FIG. 9, housing 12 has two opposing short sides 406 and 408 and two opposing long sides 410 and 412. Housing 12 have a longitudinal axis such as longitudinal axis 414 that runs parallel to the longer edges of housing 12 (i.e., parallel to sides 410 and 412 in the example of FIG. 9). In the FIG. 9 example, antenna slot 400 runs parallel to longitudinal axis 414. When a user of device 10 holds device 10 in a portrait orientation, edge 406 may point upwards and edge 408 may point downwards (e.g., towards the Earth). Device 10 may also be used in other orientations. Antenna 40 of FIG. 9 may be indirectly fed or directly fed. For example, antenna 40 may have an antenna feed formed from feed terminals on opposing sides of slot 400 such as positive antenna feed terminal 98 and ground antenna feed terminal 100. Slot 400 of FIG. 9 may be filled with air, plastic, or other dielectric material.

Figure 10:
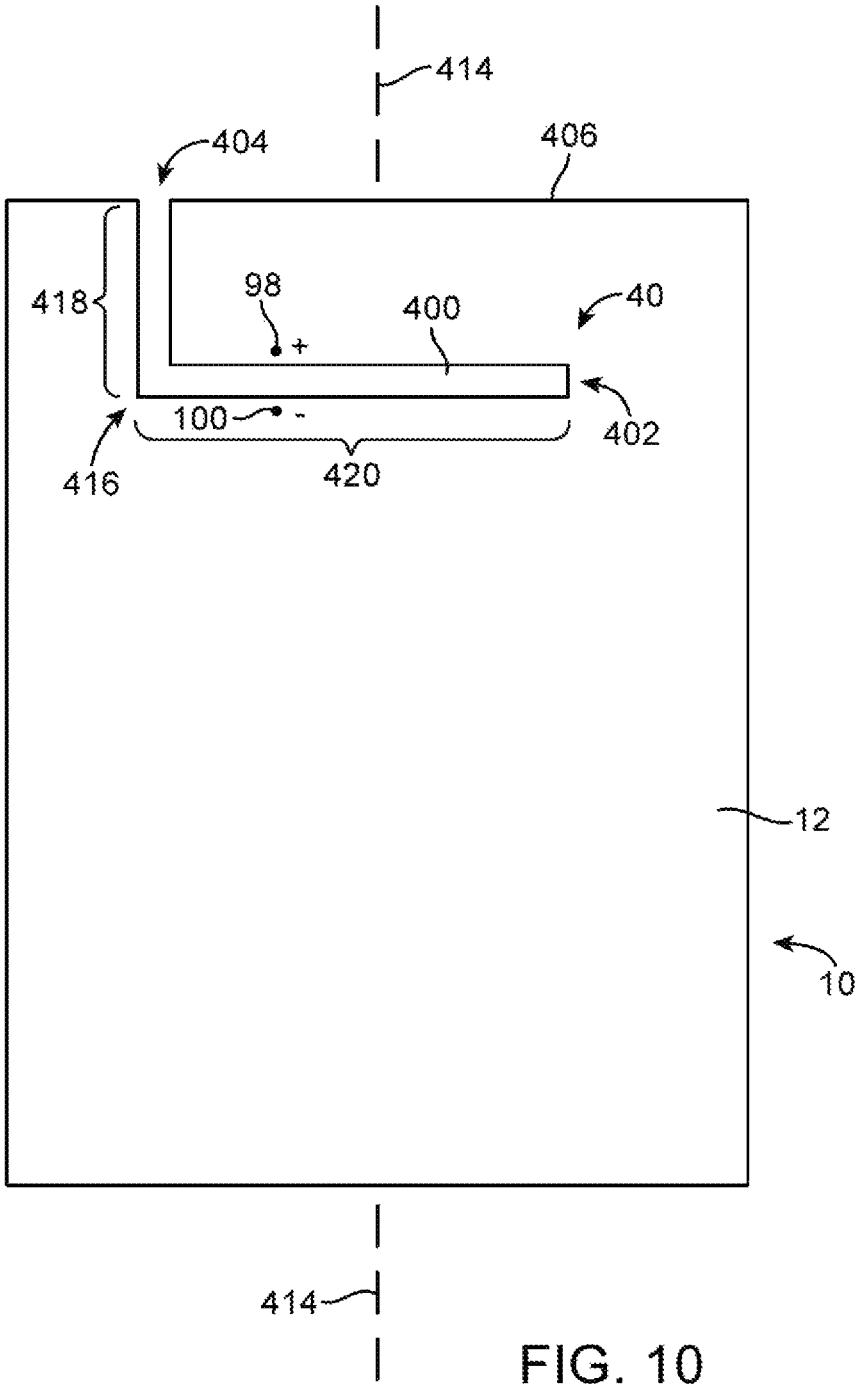
FIG. 10 is a top view of an illustrative ground plane in an electronic device that has an antenna based on an open-ended slot having at least one bend and having an opening on a short edge of the ground plane in accordance with an embodiment.

FIG. 10 shows how antenna slot 400 may have one or more bends such as bend 416. In the FIG. 10 example, slot 400 has a first portion such as portion 418 that runs parallel to longitudinal axis 414 and a second portion such as portion 420 that runs perpendicular to longitudinal axis 414. Open end 404 of slot 400 lies along the upper edge of housing 12. Antenna 40 of FIG. 10 may be fed indirectly or may be fed using a direct feed formed from antenna feed terminals such as terminals 98 and 100. Slot 400 of FIG. 10 may be filled with air, plastic, or other dielectric material.

Figure 11:
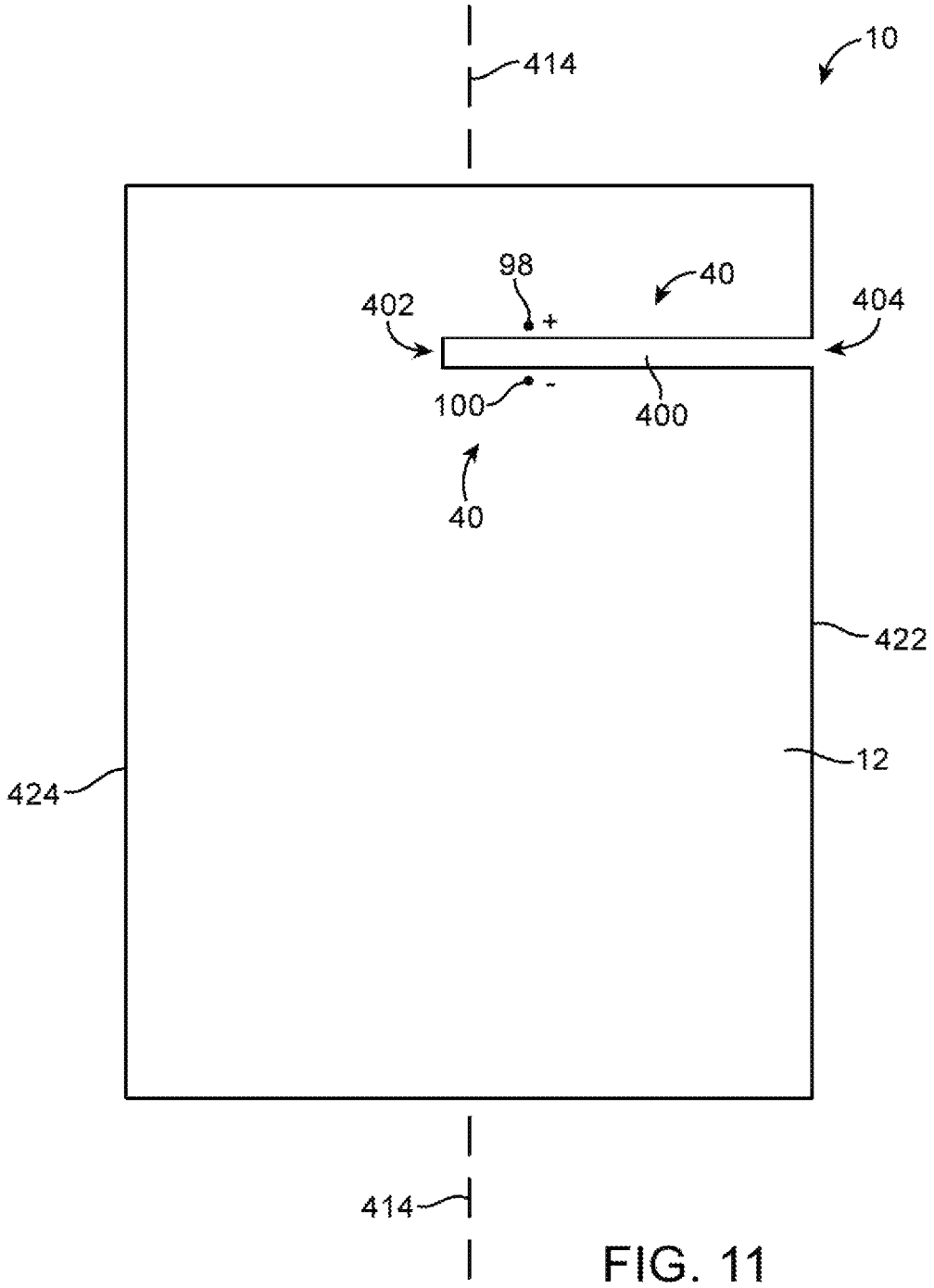
FIG. 11 is a top view of an illustrative ground plane in an electronic device that has been provided with an antenna based on an open-ended slot having an opening on a long edge of the ground plane in accordance with an embodiment.

FIG. 11 shows how antenna slot 400 may extend along a lateral dimension that runs parallel to the shorter edges of housing 12 (i.e., slot 400 may be perpendicular to longitudinal axis 414). In the FIG. 11 example, open end 404 of slot 400 exits housing (ground plane) 12 along right-hand edge 422 of housing 12. If desired, antenna 40 may be formed from a slot that has open end 404 along opposing left-hand edge 424 of housing 12 or other portion of housing 12. Slot 400 of FIG. 11 may be filled with air, plastic, or other dielectric material. Antenna 40 of FIG. 11 may be fed indirectly or may be fed using a direct feed formed from antenna feed terminals such as terminals 98 and 100 coupled to metal housing 12.

Figure 12:
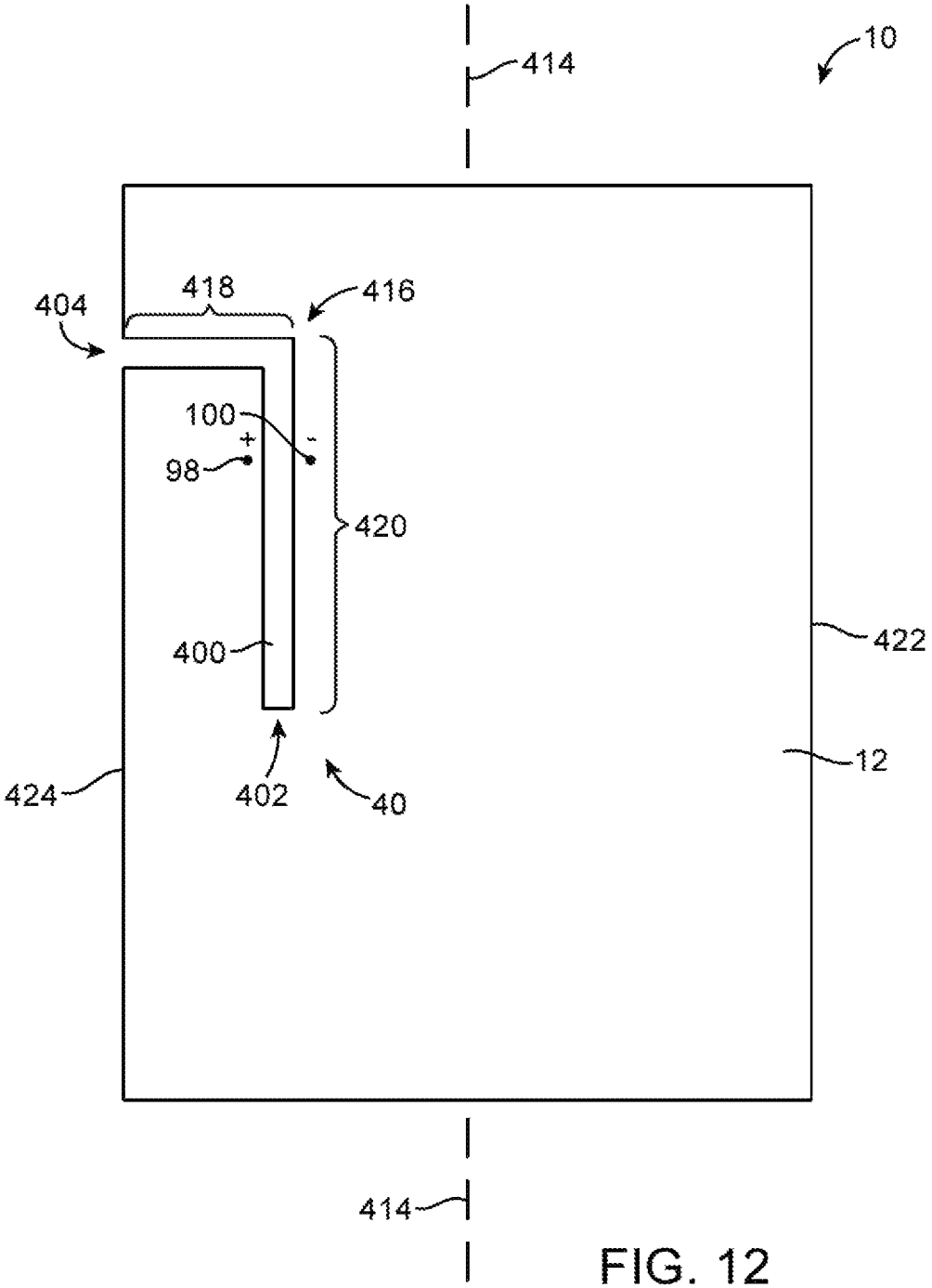
FIG. 12 is a top view of an illustrative ground plane in an electronic device that has been provided with an antenna based on an open-ended slot having at least one bend and having an opening on a long edge of the ground plane in accordance with an embodiment.

In the illustrative configuration of FIG. 12, antenna slot 400 has a bend such as bend 416 between slot segment 418 and slot segment 420. Slot segment 420 has closed end 402. Slot segment 418 has open end 404. Open end 404 exits housing 12 (i.e., the ground plane formed from housing 12) along left-hand edge 424. If desired, open end 404 may exit housing 12 along right-hand edge 222 of housing 12 or elsewhere in housing 12. In the example of FIG. 12, segment 418 runs perpendicular to longitudinal device axis 414 of housing 12 and segment 420 runs parallel to longitudinal axis 414, but other orientations for segments 418 and segment 420 may be used, if desired. Antenna 40 of FIG. 12 may be indirectly fed or directly fed (e.g., slot 400 may be fed using antenna feed terminals 98 and 100). Slot 400 of FIG. 12 may be filled with air, plastic, or other dielectric material.

Figure 13:
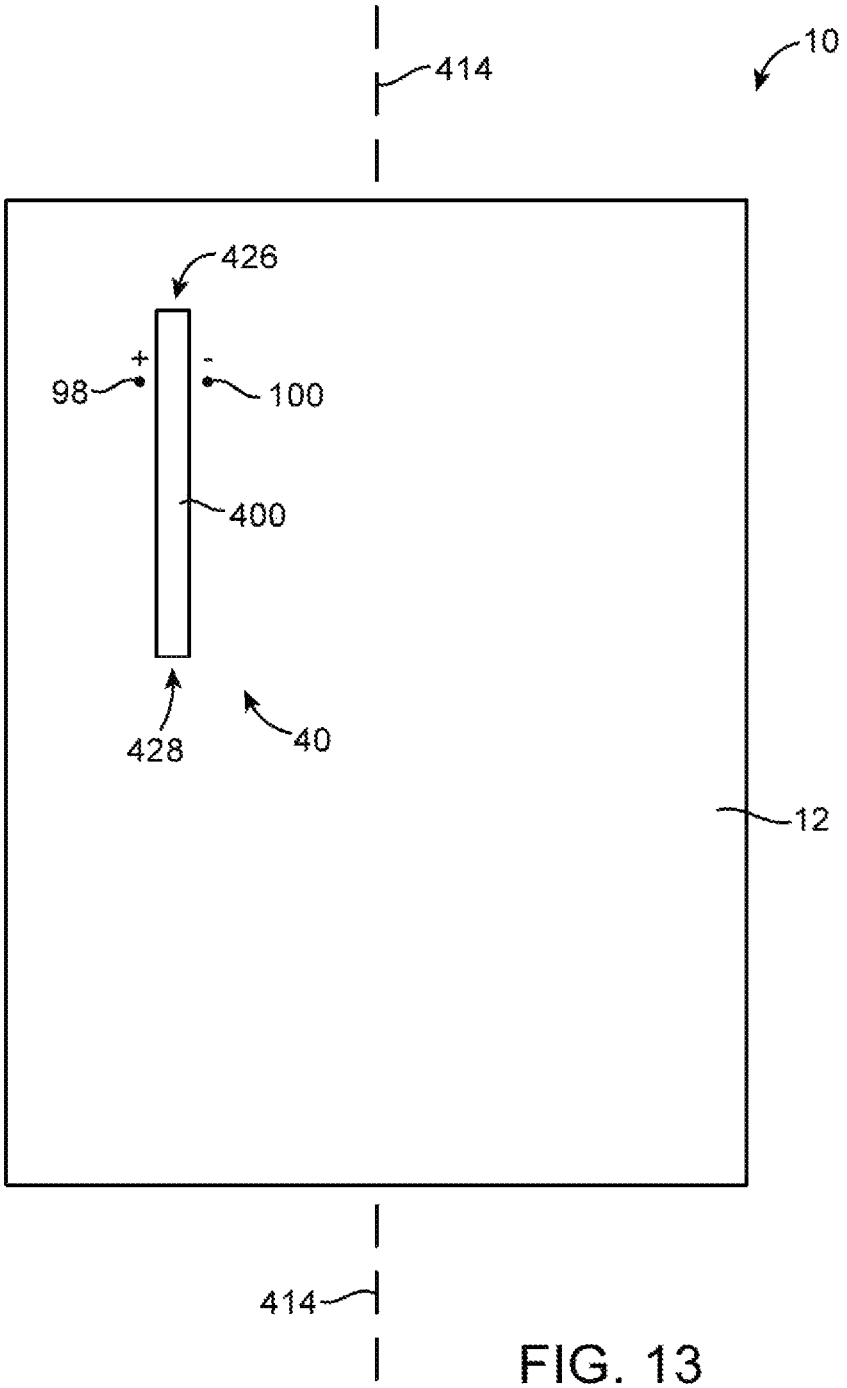
FIG. 13 is a top view of an illustrative ground plane in an electronic device that has been provided with an antenna based on a closed slot in accordance with an embodiment.

If desired, slot antenna 40 in device 10 may be formed from a closed slot (i.e., a slot having two opposing closed ends). This type of configuration is shown in FIG. 13. Slot antenna 40 has a closed slot such as slot 400 with opposing ends 426 and 428. Slot 400 is a closed slot because both ends of slot 400 are surrounded by conductive portions of metal housing (ground) 12 (i.e., ends 426 and 428 are both closed). Antenna slot 400 may run parallel to longitudinal axis 414 (as shown in the example of FIG. 13), may run across housing 12 perpendicular to axis 414, may have one or more bends such as bend 416 of FIG. 12, or may have other configurations. Slot 400 may contain air, plastic, or other dielectric material. An indirect feeding configuration may be used for slot 400 or slot 400 may be fed directly using antenna feed terminals 98 and 100.

Figure 14:
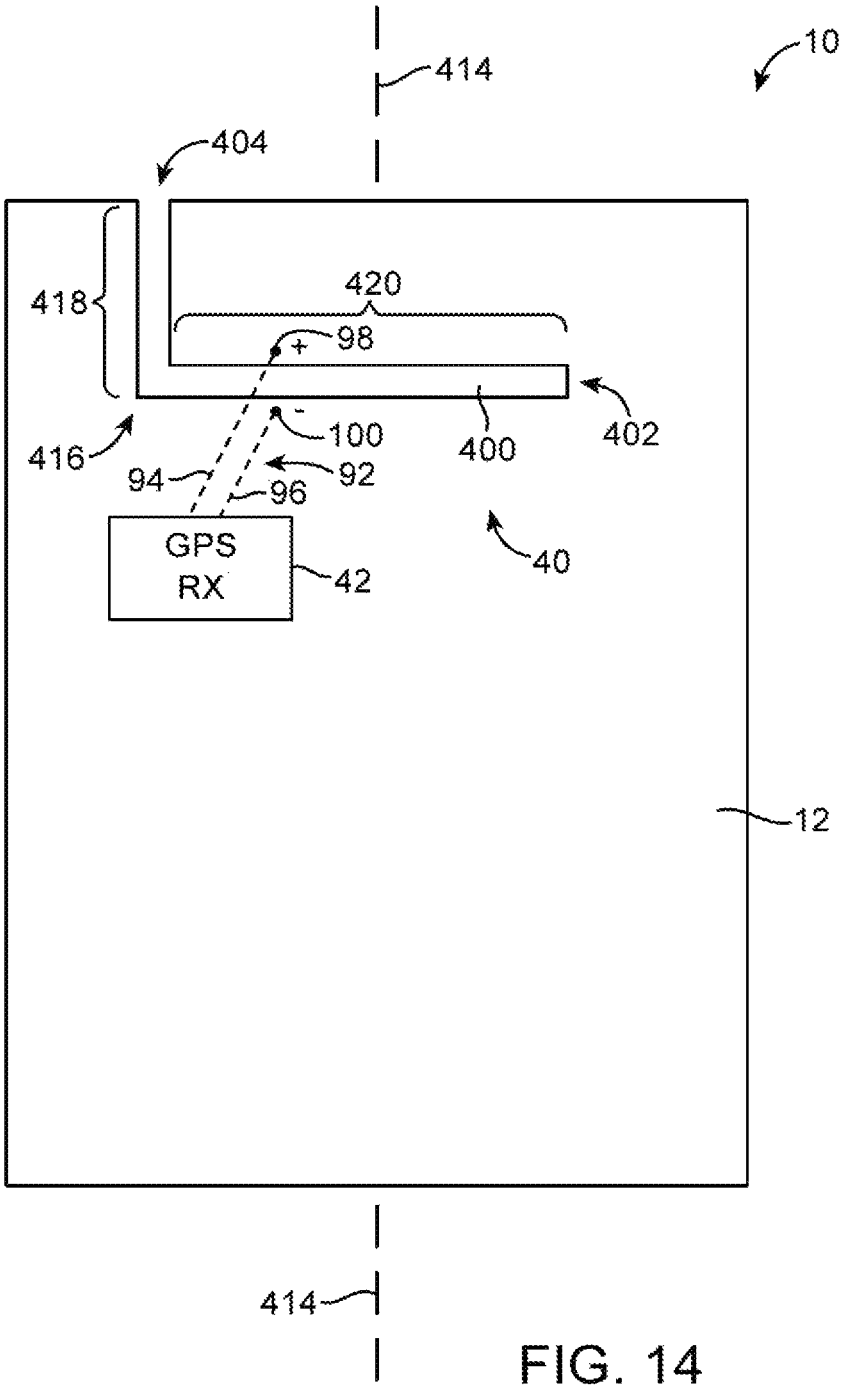
FIG. 14 is a top view of an illustrative slot antenna that is being directly fed in accordance with an embodiment.

FIG. 14 shows how a slot antenna may be directly fed using antenna terminals 98 and 100. Terminals 98 and 100 may be connected to housing 12 (e.g., the ground plane) on opposing sides of slot 400. Slot 400 may have segments such as segment 420 and segment 418 that are separate by one or more bends such as bend 416 or may have other shapes. Slot 400 may be an open slot having an open end such as end 404 that exits housing 12 along one of its edges or may be a closed slot of the type shown in FIG. 13.

In a direct feeding arrangement, radio-frequency transceiver circuitry such as satellite navigation system receiver 42 (e.g., a Global Positioning System receiver or a receiver in another type of satellite navigation system) and/or other transceiver circuitry 90 (e.g., cellular telephone transceiver circuitry 38 and/or wireless local area network transceiver circuitry 36) may be coupled to feed terminals 98 and 100 using transmission line path 92. Transmission line 92 may include positive signal line 94 and ground signal line 96. Positive signal line 94 may be coupled to positive antenna feed terminal 98. Ground signal line 96 may be coupled to ground antenna feed terminal 98. During operation, receiver 42 (or other transceiver circuitry 90) may use antenna 40 to receive wireless signals such as satellite navigation system signals.

In the illustrative configuration of FIG. 14, antenna slot 400 is an open slot having an open end such as end 404 and an opposing closed end 402. Open end 404 is formed along the upper edge of housing 12. If desired, open end 404 may be formed on a different edge of housing 12. In the example of FIG. 14, segment 418 extends parallel to longitudinal axis 414 and segment 420 of slot 400 extends perpendicular to longitudinal axis 414, but segments 418 and 420 may have other orientations and/or slot 400 may be provided with no bends or two or more bends, if desired. Slot 400 may be filled with air, plastic, or other dielectric.

Terminals 98 and 100 may be connected to housing 12 using solder, using welds, using conductive adhesive, using an intermediate coupling structure such as a printed circuit with metal traces, or using other coupling techniques. If desired, circuitry such as filter circuitry, switching circuitry, and impedance matching circuitry may be interposed in path 92 between receiver 42 and antenna 40.

Figure 15:
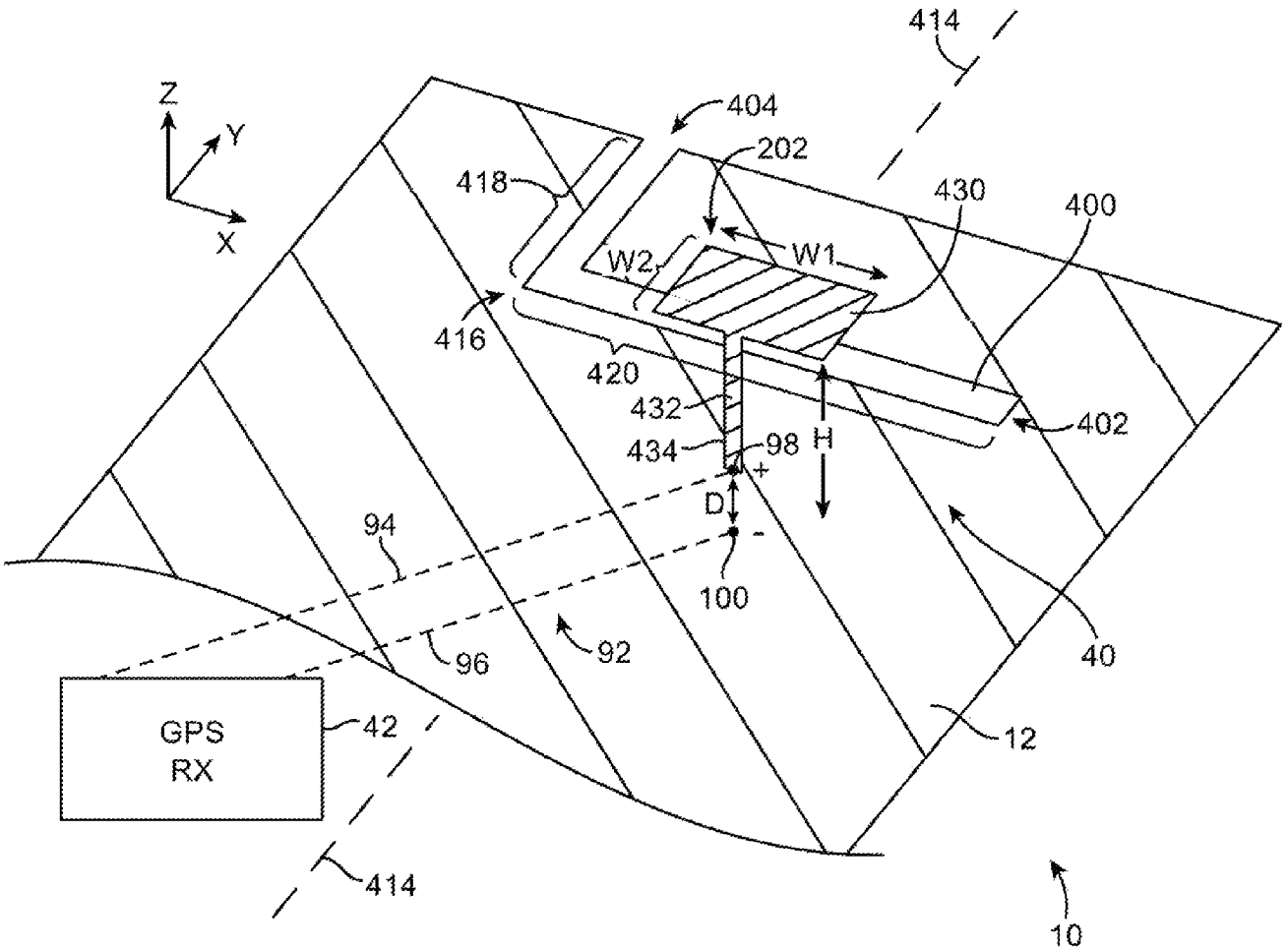
FIG. 15 is a perspective view of an illustrative indirectly-fed slot antenna in accordance with an embodiment.

Antenna 40 may be implemented using an indirect antenna feeding scheme. This type of approach is shown in FIG. 15. As shown in FIG. 15, antenna 40 has slot antenna resonating element 400 formed from a slot in metal housing (ground plane) 12 of device 10. Slot 400 in the example of FIG. 15 has segments 420 and 418 that are separated by bend 416 (i.e., bend 416 is located between segments 420 and 418). Segment 418 has open slot end 404 and segment 420 has opposing closed slot end 402. If desired, slot 400 may be a closed slot or an open slot with a different configuration. Air, plastic, or other dielectric may fill slot 400.

Radio-frequency transceiver circuitry such as satellite navigation system receiver 42 (e.g., a Global Positioning System receiver or other satellite navigation system receiver) and/or other transceiver circuitry 90 (e.g., cellular telephone transceiver circuitry 38 and/or wireless local area network transceiver circuitry 36) may be coupled to terminals 98 and 100 using transmission line path 92. Transmission line path 92 may have a positive signal line coupled to terminal 98 and may have a ground signal line coupled to ground terminal 100.

Figure 7:
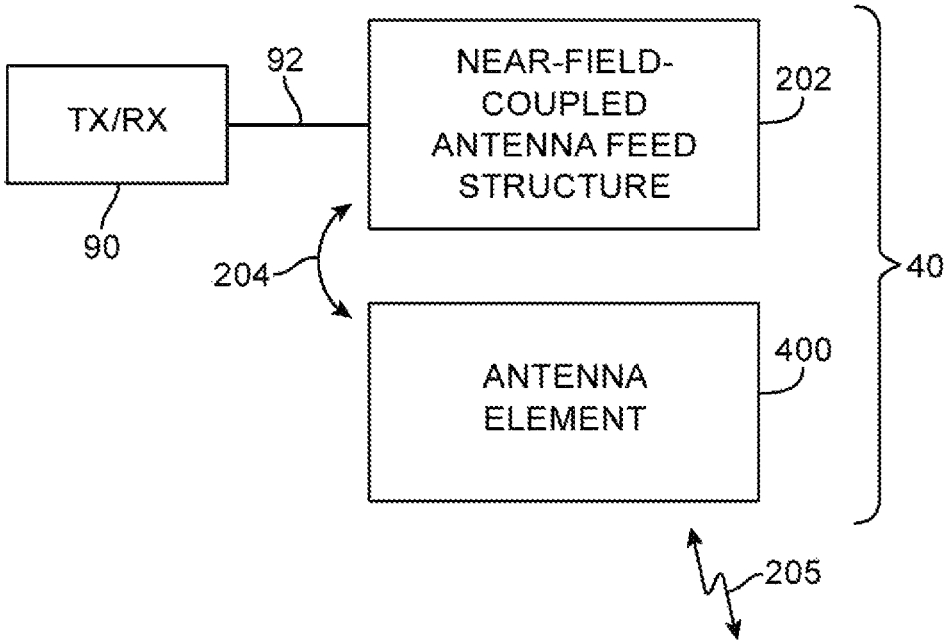
FIG. 7 is a diagram of an illustrative antenna that is being fed using near-field coupling in accordance with an embodiment.

In the indirect feeding arrangement of FIG. 15, terminals 98 and 100 are used to couple transceiver 42 (e.g., a GPS receiver) to near-field-coupled antenna feed structure 202. Near-field-coupled antenna feed structure 202, in turn, is near-field coupled to antenna slot 400 by near-field electromagnetic signals 204 (FIG. 7). During operation, antenna signals (signals 205 of FIG. 7) such as satellite navigation system signals from satellites in orbit around the Earth are received by slot antenna resonating element 400. Due to the coupling of slot 400 and structure 202, the received antenna signals are provided to receiver 42 via slot 400, structure 202, and transmission line path 92.

In the illustrative configuration of FIG. 15, near-field-coupled antenna feed structure 202 is formed from a planar piece of metal such as metal patch 430. The planar metal of patch 430 may lie in a plane that is parallel to the plane of the rear wall of housing 12. Patch 430 may overlap slot 400 (e.g., patch 430 may overlap segment 420). Leg 432 of near-field-coupled antenna feed structure 202 extends downward towards housing 12 from patch 430 along the vertical Z axis of FIG. 15. Positive terminal 98 is connected to tip 434 of leg 432. Ground terminal 100 is coupled to housing 12 below terminal 98. A distance D separates terminal 98 and terminal 100 (in the FIG. 15 example).

Patch 430 of near-field-coupled antenna feed structure 202 is separated from ground plane 12 by height H and is characterized by lateral dimensions W1 and W2. The size, shape, and location of patch 430 may be adjusted to optimize antenna performance for antenna 40 (e.g., to enhance coupling between structures 202 and slot 400, to enhance isolation between antenna 40 and other structures in device 10, to adjust the directionality of antenna 40, etc.).

In a configuration in which slot antenna 40 is directly fed, electric field intensity in slot antenna 40 may tend to be concentrated, leading to increased antenna directionality. Increased directionality may be desirable in situations in which the orientation of device 10 relative to the satellite navigation system satellites orbiting the earth is known. For example, it may be desirable for antenna 40 to exhibit some directionality in devices that are typically held in a particular portrait orientation during use of satellite navigation system functions.

Reduced directionality (i.e., omnidirectional operation or nearly omnidirectional operation) may be desirable in situations in which device 10 is typically used in a number of different orientations. The omnidirectional behavior of antenna 40 may be enhanced (i.e., directionality may be minimized) by using an indirect feeding arrangement for antenna 40. The ability to independently adjust parameters such as patch size (e.g., dimension W1 and/or dimension W2), patch location along slot 400, patch height H, etc. allows characteristics such as capacitance and near-field coupling to be adjusted. By adjusting these attributes of structure 202, antenna performance can be adjusted. For example, antenna signal phase can be adjusted to reduce coupling between antenna 40 and adjacent additional antennas such as additional antennas 40A of FIG. 8.

Figure 16:
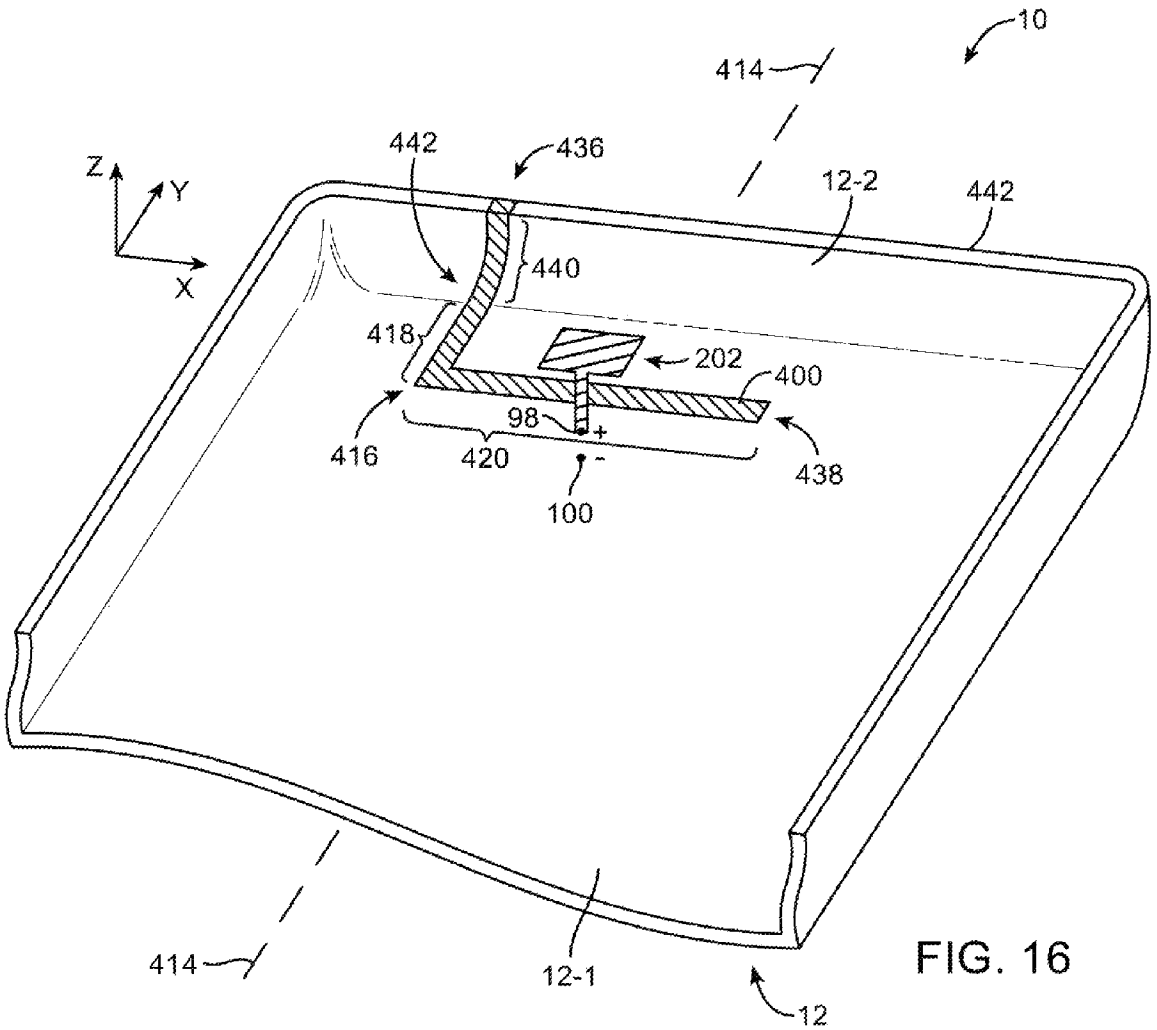
FIG. 16 is a perspective view of an illustrative interior portion of an electronic device having an electronic device housing slot for forming an indirectly fed slot antenna in accordance with an embodiment.

If desired, slot antenna 40 (e.g., slot antennas of the types shown in FIGS. 9, 10, 11, 12, 13, 14, and 15) may have slots that extend up curved or flat vertical housing sidewalls. As shown in FIG. 16, housing 12 may have a planar rear housing wall such as planar rear wall 12-1. The housing surface formed from wall 12-1 may lie in the X-Y plane of FIG. 16. Housing sidewalls such as top sidewall 12-2 may extend vertically upwards (in direction Z) from rear wall 12-1. For example, in a rectangular device with a rectangular housing, housing 12 may have four sidewalls that run around the rectangular periphery of housing 12. Housings with other shapes may have sidewalls in other configurations.

Sidewall 12-2 may be formed at the upper end of device 10, may be formed at the opposing lower end of device 10, or may run along the left or right side of device 10. Sidewalls such sidewall 12-2 may be flat or may be curved.

Slot 400 may have a portion that is formed in housing sidewall 12-2. As shown in FIG. 16, slot 400 (e.g., a slot filled with plastic or other solid dielectric material) may have a first segment such as segment 420 that runs perpendicular to axis 414 across the planar rear surface of housing 12, a second segment such as segment 418 that runs parallel to axis 414 across the planar rear surface of housing 12 towards upper sidewall 12-1, and a third segment such as segment 440. Segment 440 may extend upwards in dimension Z across sidewall 12-2.

Slot 400 may be indirectly fed using near-field-coupled antenna feed structure 202. Slot 400 may have a closed end such as closed end 438 and an opposing open end such as open end 436. End 436 may exit sidewall 12-2 along housing sidewall edge 442. Horizontal bend 416 is located between segments 420 and 418. Vertical bend 442 is located between segments 418 and 440.

The use of a slot resonating element for antenna 40 may impart directionality to antenna 40. Antenna 40 may therefore operate more efficiently in some directions than in others. When, for example, the slot of antenna 40 exits an edge of a rectangular ground plane such as housing 12, electric field intensity may peak along the portion of the slot exiting the ground plane and may enhance antenna efficiency for directions running parallel to the slot (i.e., antenna efficiency in this type of arrangement may be greatest in the direction of the slot at its exit from ground plane 12).

Some electronic devices are frequently used in particular orientations. For example, a user of a handheld electronic device with a longitudinal axis such as axis 414 of FIG. 10 may tend to operate the device in an upright portrait orientation in which axis 414 is pointed upwards towards GPS satellites (i.e., away from the Earth). Antennas for this type of electronic device that contain vertical segments of slot 400 (see, e.g., slot segment 418 of FIG. 10) can therefore exhibit good efficiency.

Figure 17:
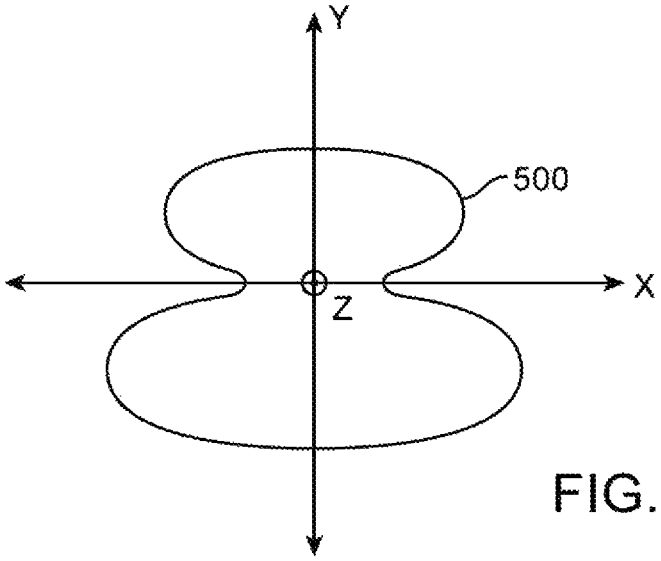
FIG. 17 is a graph of antenna efficiency for an illustrative slot antenna having a slot segment that exits a ground plane horizontally parallel to an X axis in accordance with an embodiment.

FIG. 17 is a graph in which antenna efficiency has been plotted as a function of antenna operating direction for an antenna of the type shown in FIG. 11 in which antenna slot 400 exits ground plane 12 perpendicular to longitudinal axis 414 of device 10. The Y-axis of FIG. 17 is aligned with longitudinal axis 414. Curve 500 represents antenna efficiency for all different possible directions in the X-Y plane (i.e., the plane containing ground plane 12 of FIG. 11). The larger the distance between the origin of the graph of FIG. 11 and curve 500, the greater the efficiency of the antenna. The efficiency plot of FIG. 17 is rotationally symmetric about the Y-axis of FIG. 11. As shown in the graph of FIG. 17, antenna efficiency is greatest in directions that are roughly orientated along axis X and are lower in directions along axis Y.

Figure 18:
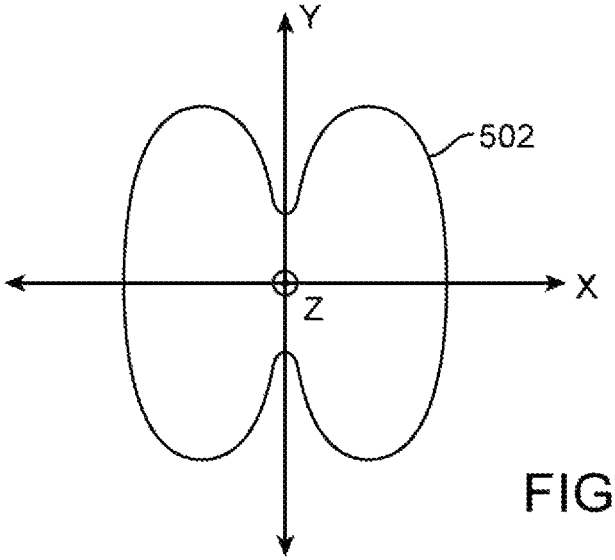
FIG. 18 is a graph of antenna efficiency for an illustrative slot antenna having a slot segment that exits a ground plane vertically parallel to a Y axis in accordance with an embodiment.

FIG. 18, in contrast, is a graph in which antenna efficiency has been plotted for an antenna of the type shown in FIG. 9 or of the type shown in FIG. 10 in which the portion of slot 400 that is exiting ground plane 12 (i.e., slot segment 418) is oriented along the Y-axis of device 10 (i.e., along longitudinal axis 414). Antenna efficiency plot 502 of FIG. 18 is rotationally symmetric about the X axis of FIG. 18. In a usage scenario in which device 10 is held in an upright portrait orientation, axis Y of device 10 (i.e., longitudinal axis 414 of FIGS. 9 and 10) will point upwards towards the GPS satellites orbiting the earth and the efficiency of device 10 in gathering GPS signals will be enhanced.

Other types of antennas with vertically extending slot portions at the exit of ground plane 12 may perform similarly. For example, slot 400 of FIG. 9 may give rise to enhanced antenna efficiency along axis 414 because slot 400 exits ground plane 12 parallel to longitudinal axis 414. And, as another example, slot segment 418 of slot 400 of FIG. 12 may give rise to reduced antenna efficiency along axis 414 because slot segment 418 exits ground plane 12 perpendicular to axis 414. Antennas of the type shown in FIGS. 9 and 10 will also exhibit satisfactory operation when device 10 is in other orientations (e.g., landscape modes such as a home-button-left mode or home-button-right mode, an orientation in which the flat display surface of device 10 is facing upwards towards earth-orbiting satellites in a satellite navigation system, etc.).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a satellite navigation system receiver;

a metal housing in which the satellite navigation system receiver is housed;

a slot antenna formed from a slot in the metal housing wherein the slot antenna is an indirectly fed slot antenna having a near-field-coupled antenna feed structure that is near-field coupled to the slot, wherein the antenna feed structure comprises a planar metal structure and a leg that extends from the planar metal structure towards a rear wall of the metal housing; and a transmission line that conveys antenna signals from the slot antenna to the satellite navigation system receiver.

2. The electronic device defined in claim 1 wherein the metal housing forms a ground plane, wherein the slot is formed in the ground plane, and wherein the slot has at least one bend.

3. The electronic device defined in claim 1 wherein the slot antenna has at least one bend and the slot is an open slot having an open end at an edge of the metal housing.

4. An electronic device, comprising:

a satellite navigation system receiver;

a metal housing in which the satellite navigation system receiver is housed;

a slot antenna formed from a slot in the metal housing, wherein the metal housing has a rear housing wall and a sidewall, the slot has first and second segments, the first segment is formed in the rear housing wall, the second segment is formed in the sidewall, and the slot antenna is a directly fed slot antenna having a positive antenna feed terminal coupled to the metal housing on one side of the first segment and having a ground antenna feed terminal coupled to the metal housing on an opposing side of the first segment; and a transmission line that conveys antenna signals from the slot antenna to the satellite navigation system receiver.

5. An electronic device, comprising:

a satellite navigation system receiver;

a metal housing in which the satellite navigation system receiver is housed;

a slot antenna formed from a slot in the metal housing wherein the metal housing has a rear housing wall and has a sidewall, wherein the slot has a first segment in the rear housing wall, a second segment in the rear housing wall, and a third segment in the sidewall and the slot has a first bend between the first and second segments and has a second bend between the second and third segments; and a transmission line that conveys antenna signals from the slot antenna to the satellite navigation system receiver.

6. The electronic device defined in claim 5 wherein the slot antenna comprises a near-field-coupled antenna feed structure that is near-field coupled to the slot.

7. The electronic device defined in claim 6 wherein the near-field-coupled antenna feed structure comprises a planar metal structure.

8. The electronic device defined in claim 7 wherein the planar metal structure overlaps the second segment.

9. The electronic device defined in claim 7 wherein the near-field-coupled antenna feed structure comprises a leg that extends from the planar metal structure.

10. The electronic device defined in claim 9 wherein a positive antenna feed terminal is coupled to the leg, a ground antenna feed terminal is coupled to the metal housing, the transmission line has a positive signal line that is coupled to the positive antenna feed terminal, and the transmission line has a ground antenna signal line that is coupled to the ground antenna feed terminal.

11. The electronic device defined in claim 10 further comprising an additional antenna.

12. An electronic device, comprising:

a satellite navigation system receiver;

a metal housing; and an indirectly fed slot antenna formed from a slot in the metal housing that provides antenna signals to the satellite navigation system receiver, wherein the metal housing has a rear housing wall and a sidewall, the slot has a segment formed in the sidewall that extends from a first edge of the sidewall to an opposing second edge of the sidewall, the slot serves as an antenna resonating element for the indirectly fed slot antenna, and the indirectly fed slot antenna comprises a near-field-coupled antenna feed structure that is near-field coupled to the slot.

13. The electronic device defined in claim 12 wherein the near-field-coupled antenna feed structure comprises a metal patch.

14. The electronic device defined in claim 13 wherein the metal patch overlaps the slot.

15. The electronic device defined in claim 14 wherein the slot comprises a closed slot having two closed ends.

16. A satellite navigation system slot antenna configured to receive satellite navigation system signals in an electronic device, comprising:

a slot antenna resonating element formed from a plastic-filled slot in a metal housing for the electronic device, wherein the metal housing has a rear housing wall and a sidewall, the slot has first and second segments, the first segment is formed in the rear housing wall, and the second segment is formed in the sidewall; and a near-field-coupled antenna feed structure that is near-field coupled to the slot antenna resonating element, wherein the near-field coupled antenna feed structure comprises a metal patch that overlaps the slot.

* * * * *